US006765463B2

(12) United States Patent
Mader et al.

(10) Patent No.: US 6,765,463 B2
(45) Date of Patent: Jul. 20, 2004

(54) RELAY

(75) Inventors: Leopold Mader, Moedling (AT); Rudolf Mikl, Arbesthal (AT)

(73) Assignee: Tyco Electronics Austria, GmbH, Vienna (AT)

( * ) Notice: Subject to any disclaimer, the term of this patent is extended or adjusted under 35 U.S.C. 154(b) by 0 days.

(21) Appl. No.: 10/158,546

(22) Filed: May 30, 2002

(65) Prior Publication Data

US 2003/0016104 A1 Jan. 23, 2003

(30) Foreign Application Priority Data

Jun. 22, 2001 (EP) ..... 01115209

(51) Int. Cl.[7] ..... H01H 67/02
(52) U.S. Cl. ..... 335/128; 335/129
(58) Field of Search ..... 335/78–86, 124, 335/128–131, 202, 132; 336/192, 198; 29/622

(56) References Cited

U.S. PATENT DOCUMENTS 5,790,004 A * 8/1998 Matsuoka et al. ..... 335/78

FOREIGN PATENT DOCUMENTS

DE 19804572 A1 8/1999 ..... H01H/50/64

* cited by examiner

*Primary Examiner*—Lincoln Donovan

(57) ABSTRACT

The invention relates to a relay designed with integral parts to simplify assembly, reduce manufacturing costs, and increase strength. The relay has a coil base member. The coil base member has a base member and a coil member integrally connected. The base member has an upper side, side faces and a bottom surface. The coil member has inner sides. The coil base member has a side opening that extends from the inner sides of the coil member to the upper side of the base member and to the side faces and bottom surface of the base member.

4 Claims, 19 Drawing Sheets

RELAY

BACKGROUND OF THE INVENTION

The invention relates to a relay and, more specifically, to a relay designed with integral parts to simplify assembly, reduce manufacturing costs, and increase strength.

DESCRIPTION OF THE PRIOR ART

A relay is an electromagnetically actuated, electrical switch. Conventional relays commonly require a wide variety of components, many of which have similar features. As a result of the magnitude of components required in the conventional relay, the costs and assembly time associated with the manufacture of the conventional relay are extensive.

One example of a conventional relay is disclosed in DE 198 04 572 A1. The relay has a coil base member, a cover, a spring system and a magnet system. The coil base member is made of an electrically insulating material and comprises a base member connected to a coil member. The magnet system has a coil, a yoke and a tilting armature. The coil is a cylindrical hollow member with a rectangular internal cross section corresponding to a cross section of the yoke and has a collar at a free end. The spring system has at least one release spring, one switching spring and one operating spring. The release spring, switching spring and operating spring have an integral foot with a depth end stop, a locking device and at least one contact tongue of one-piece construction that may be inserted into insert slits in the base member. At least one armature spring is constructed in one piece with one of the springs and is arranged parallel thereto. A comb couples the tilting armature and the switching spring. The cover has stops for positioning the release and operating springs and for covering the relay.

Because the number of components and features used in the relay heightens cost, it is desirable to provide a relay having a limited amount of components to decrease manufacturing and assembly costs and increase overall strength.

SUMMARY OF THE INVENTION

In a first embodiment, a relay has a coil base member. The coil base member has a base member and a coil member integrally connected. The base member having an upper side, side faces and a bottom surface. The coil member having inner sides. The coil base member having a side opening that extends from the inner sides of the coil member to the upper side of the base member and to the side faces and bottom surface of the base member.

In an alternate embodiment, a relay has a coil base member and a magnet system. The coil base member has a base member and a coil member. The magnet system has a coil, a yoke and a tilting armature. The yoke has a yoke web, upper yoke cross-bars and lower yoke cross-bars. The tilting armature has an armature web, upper armature cross-bars and lower armature cross-bars. The titling armature and the yoke are formed such that the tilting armature and the yoke are mirror-inverted when in an installation position for installment in the coil base member.

In an alternate embodiment, a relay has a coil base member, a magnet system and a spring system. The coil base member has a base member and a coil member. The magnet system has a coil, a yoke and a tilting armature. The spring system has a release spring, a switching spring, and an operating spring each having an integral foot element having a locking device that fixes the foot element in the base member.

BRIEF DESCRIPTION OF THE DRAWINGS

FIG. 13 is a perspective view of a second embodiment of a relay without a cover;

DETAILED DESCRIPTION OF THE PREFERRED EMBODIMENT

Figure 1:
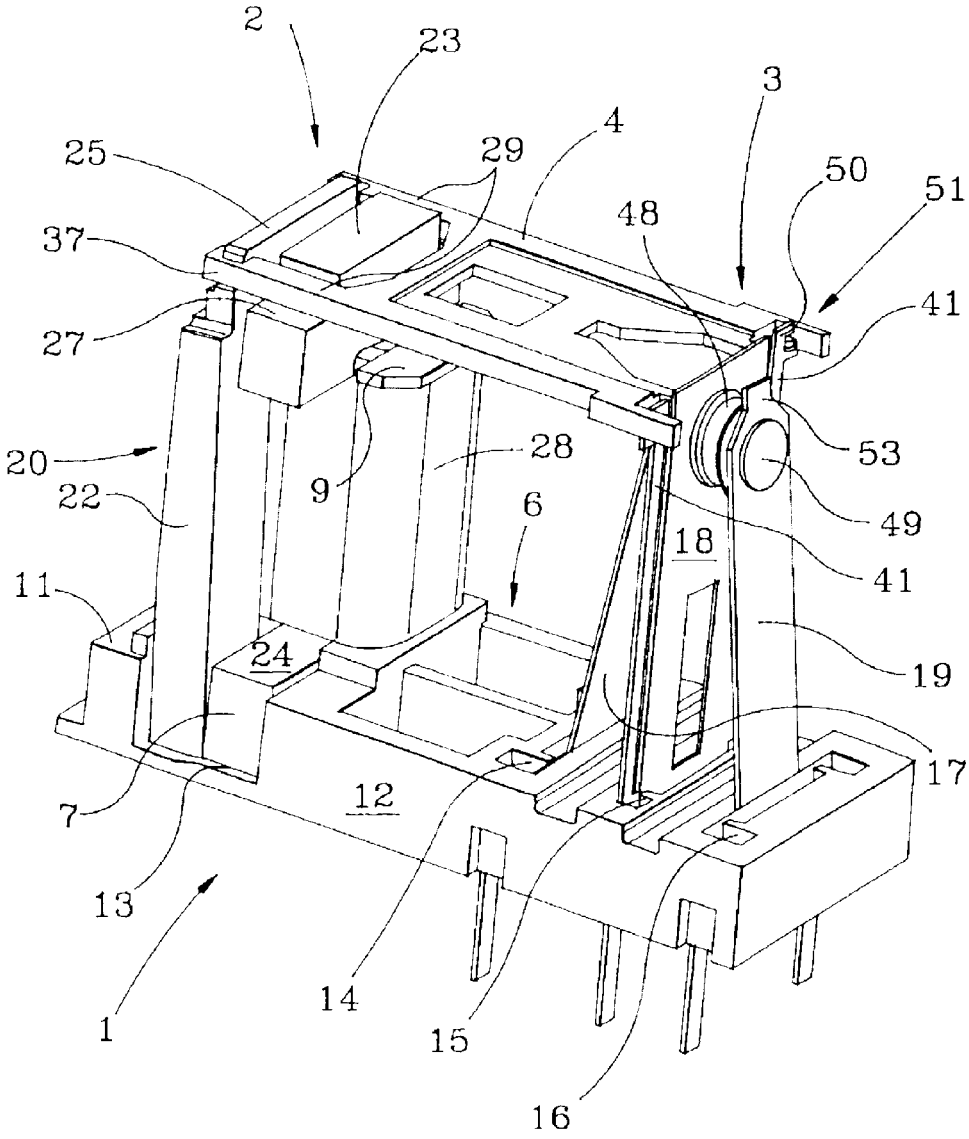
FIG. 1 is a perspective view of a first embodiment of a relay without a cover.

FIG. 1 shows a first embodiment of a relay having a coil base member 1 and a magnet system 2 connected to a spring system 3 by a comb 4. Shown in FIGS. 1 and 2, the coil base member 1 is made out of an electrically insulating material and comprises an integrally connected coil member 5 and a base member 6. The coil member 5 is a substantially cylindrical hollow member with a substantially rectangular internal cross section corresponding to a cross section of a yoke 7, shown in FIG. 3. Shown in FIG. 2, the internal cross section comprises narrow inner sides 8 and has a collar 9 arranged at a free end. The collar 9 has a locating lug 40.

Figure 2:
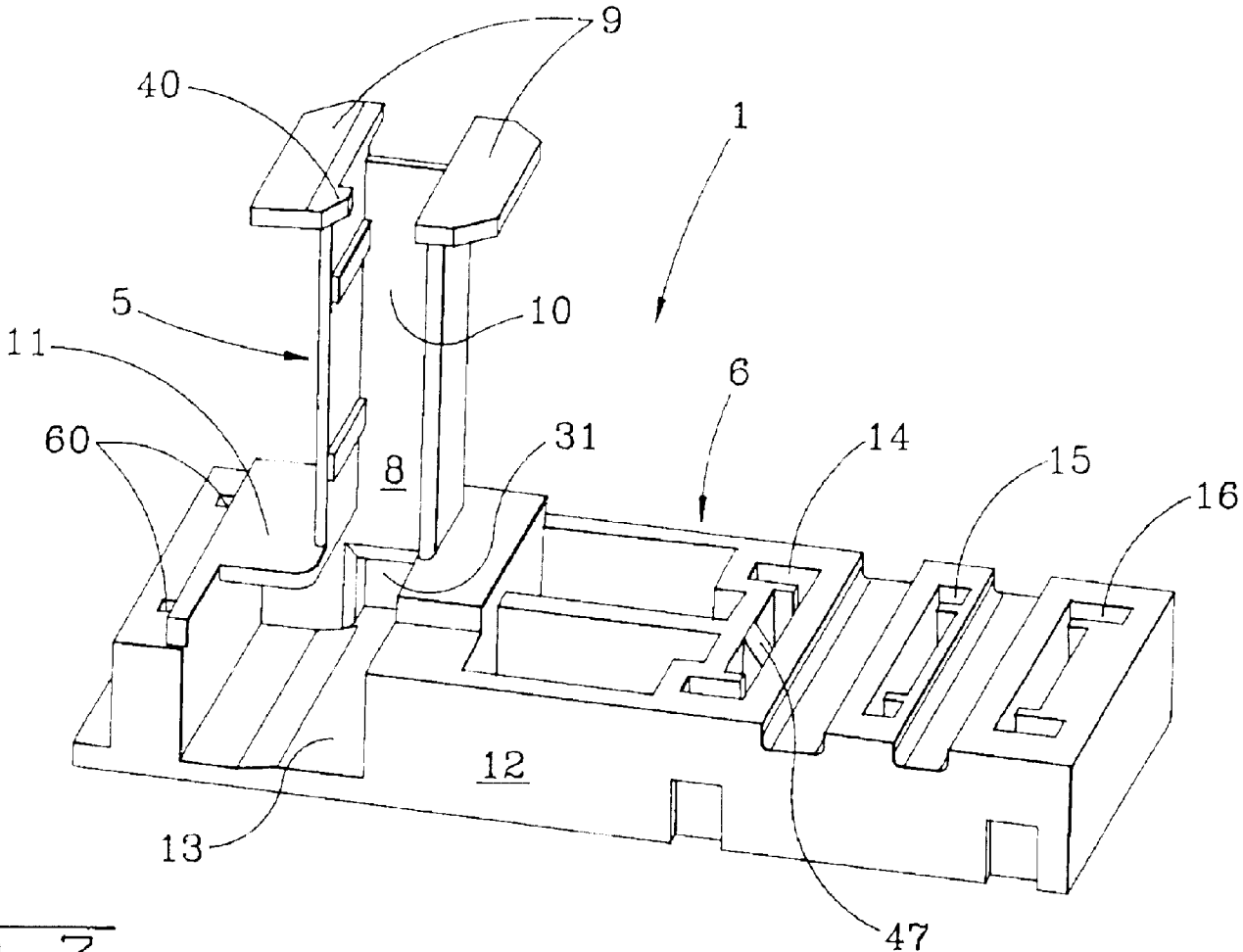
FIG. 2 is a perspective view of a coil base member of the relay of FIG. 1.
Figure 3:
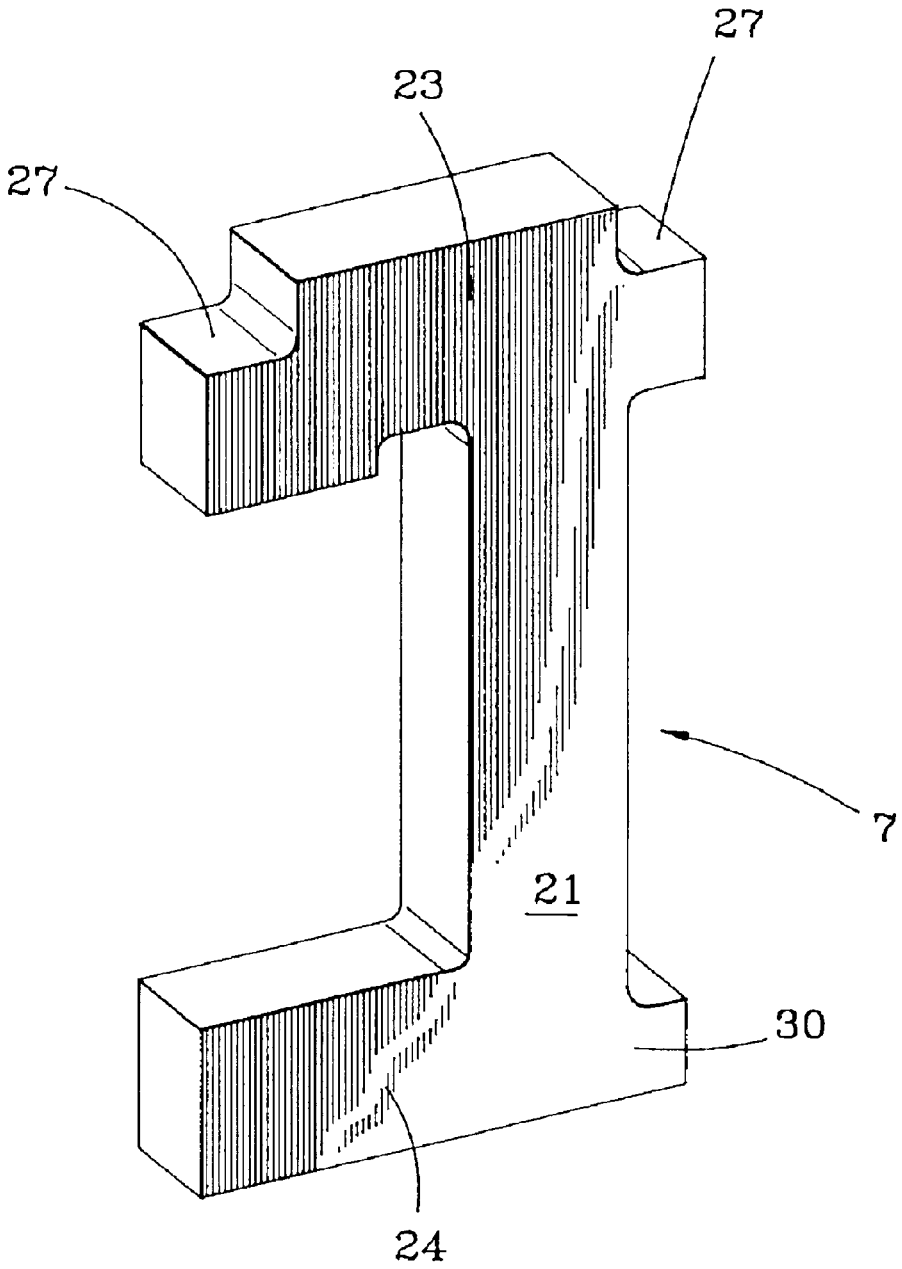
FIG. 3 is a perspective view of a yoke of the relay of FIG. 1.

Shown in FIG. 2, the base member 6 has side faces 12, a stepped-up bottom surface 13 and an upper side 11. The base member 6 has first, second and third insert slots 14, 15, 16 and contact pins 60. The insert slots 14, 15, 16 have locking lugs 47. A side opening 10 extends from the narrow inner sides 8 of the coil member 5 to the upper side 11 and to the side faces 12 as far as the bottom surface 13. Adjacent to the side opening 10 is an extension receiving recess 31.

Shown in FIG. 1, the magnet system 2 comprises a coil 28, the yoke 7 and a tilting armature 20. Shown in FIG. 3, the yoke 7 is substantially C-shaped and has a yoke web 21 integrally connected with upper and lower yoke cross-bars 23, 24. The upper and lower yoke cross-bars 23, 24 project beyond the yoke web 21. A first end of the upper yoke cross-bar 23 has a yoke step 27 that provides space for a fork 29 of the comb 4. Extending beyond the yoke web 21 is an extension 30. The extension 30 is formed to fit into the corresponding extension receiving recess 31 in the base member 6, shown in FIG. 2, and secures the yoke 7 in an axial position in the coil member 5.

Figure 4:
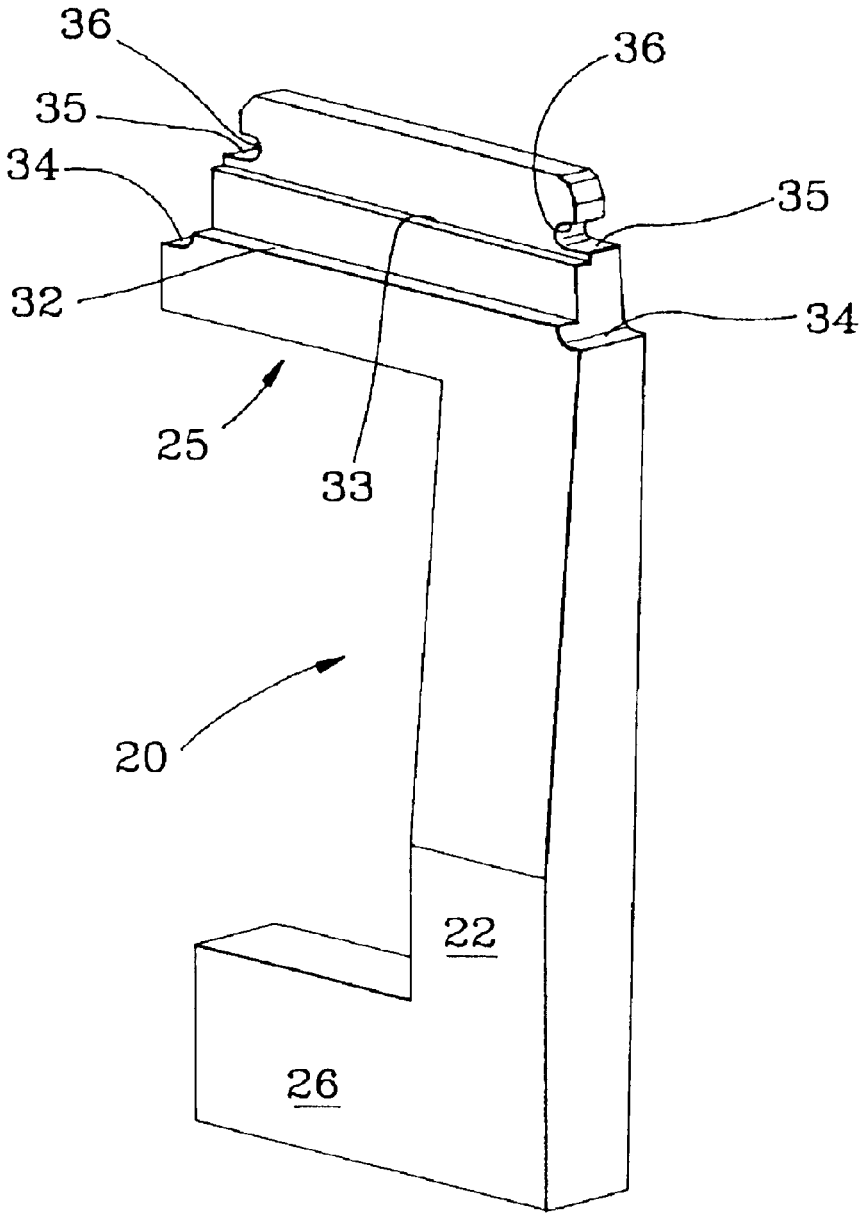
FIG. 4 is a perspective view of a side remote from a spring of a tilting armature of the relay of FIG. 1.

Shown in FIG. 4, the tilting armature 20 is substantially C-shaped and has an armature web 22 integrally connected with upper and lower armature cross-bars 25, 26. The upper armature cross-bar 25 has first and second lengthwise steps 32, 33 having first and second transverse steps 34, 35, respectively. The second transverse steps 35 have a transverse groove 36 provided for a hinge 37 of a comb fork 29 of the comb 4. In addition, the first and second transverse steps 34, 35 provide space for the comb fork 29 and for a first stop 38 of a cover 39 for attachment to the yoke 7. While the thickness of the yoke 7 is constant, the cross section of the armature web 22 decreases continuously on a side remote from the yoke 7 towards the upper armature cross-bar 25.

Figure 5:
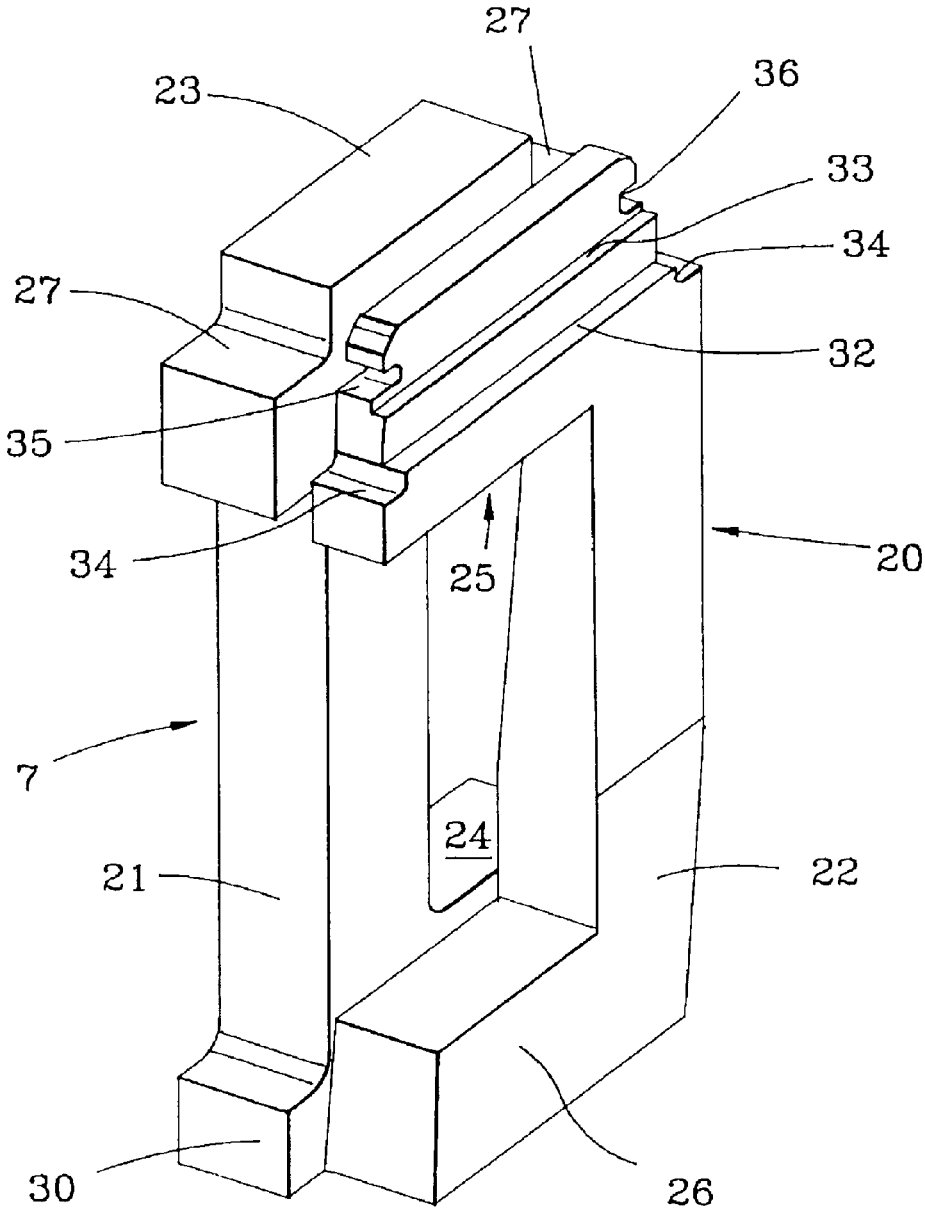
FIG. 5 is a perspective view of the tilting armature and the yoke of FIGS. 3 and 4 in an installation position.

Shown in FIGS. 1 and 5, the yoke 7 and the tilting armature 20 are mirror-inverted in an installation position for insertion into the side opening 10 of the coil base member 1 from the side. Sufficient space is provided in the side opening 10 and at the stepped-up bottom surface 13 to accommodate movement of the tilting armature 20. In contrast, the yoke 7 fits into the rectangular internal cross section of the coil member 5 with little additional space.

The extension 30 of the yoke 7 engages the extension receiving recess 31, shown in FIG. 2, and secures the yoke 7 in the axial position in the coil member 5. The resilient locating lug 40 arranged on the collar 9 positions the yoke 7 laterally and snaps into the yoke 7 when the yoke 7 reaches the installation position. The coil 28 is wound around the yoke 7, guided by the collar 9, to fix the yoke 7 in the installation position. The tilting armature 20 is guided by the edge of the side opening 10 and the lower armature cross-bar 26 as it is inserted in the base member 6.

Figure 9:
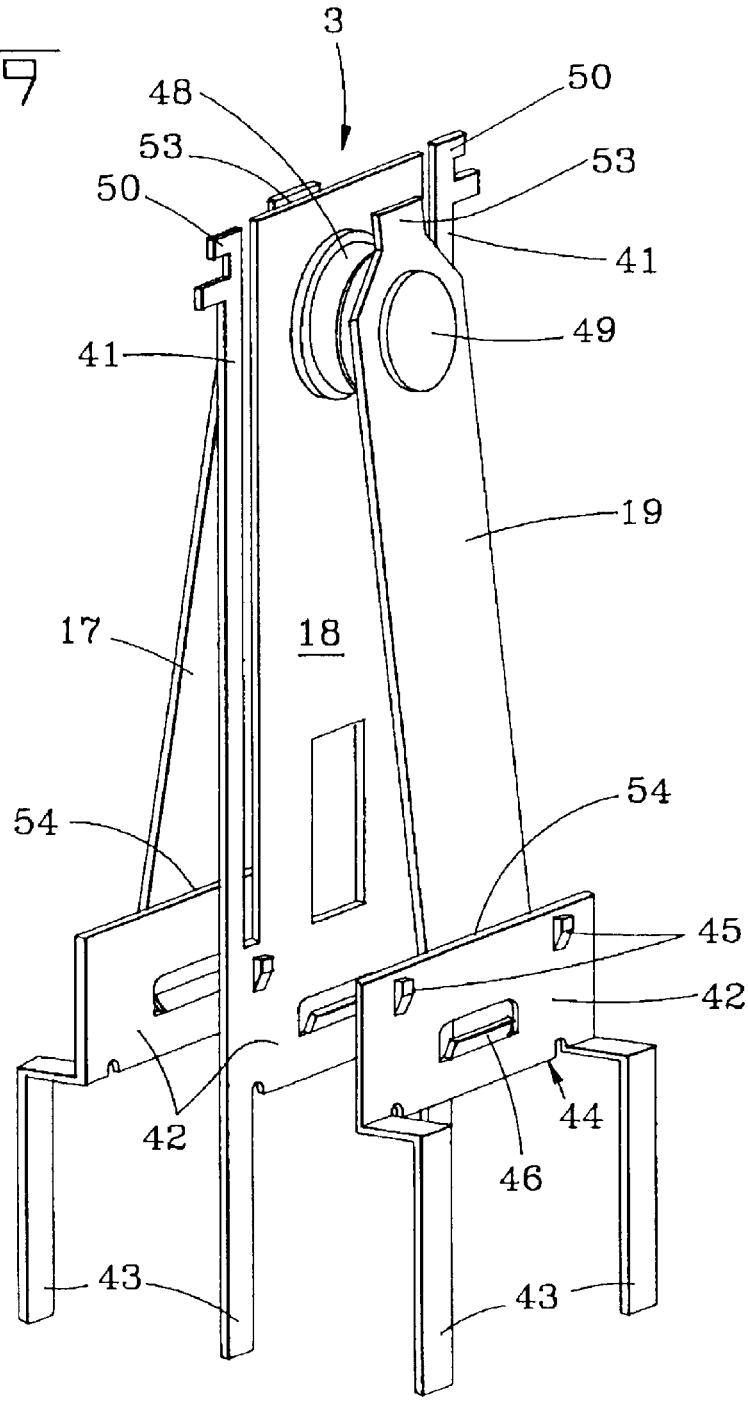
FIG. 9 is a perspective view of a spring system with the switching spring and the operating spring of FIGS. 7 and 8.

Shown in FIG. 9, the spring system 3 has a release spring 17, an operating spring 19 and a switching spring 18. The release spring 17, switching spring 18 and operating spring 19 are integrally connected by a substantially identically constructed foot element 42. Each of the foot elements 42 has a contact tongue 43 integrally connected with the foot element 42, punched buttons 45 and a locking device 46. The foot elements 42 of the operating spring 19 and the release spring 17 are have a bent configuration. The foot element 42 of the switching spring 18 has an essentially straight configuration. Although the foot elements 42 are illustrated in the described configurations, it will be appreciated by those skilled in the art that the configurations may be altered depending on the desired spacing of the contact tongues 43. Positioned between the contact tongues 43 is a depth end stop 44. The depth end stop 44 contacts a bottom surface of the insert slots 14, 15, 16, and the punched buttons 45 and the locking device 46 engage with the locking lug 47 arranged in the insert slots 14, 15, 16 when a given depth is reached to fix the foot elements 42 in position.

Figure 7:
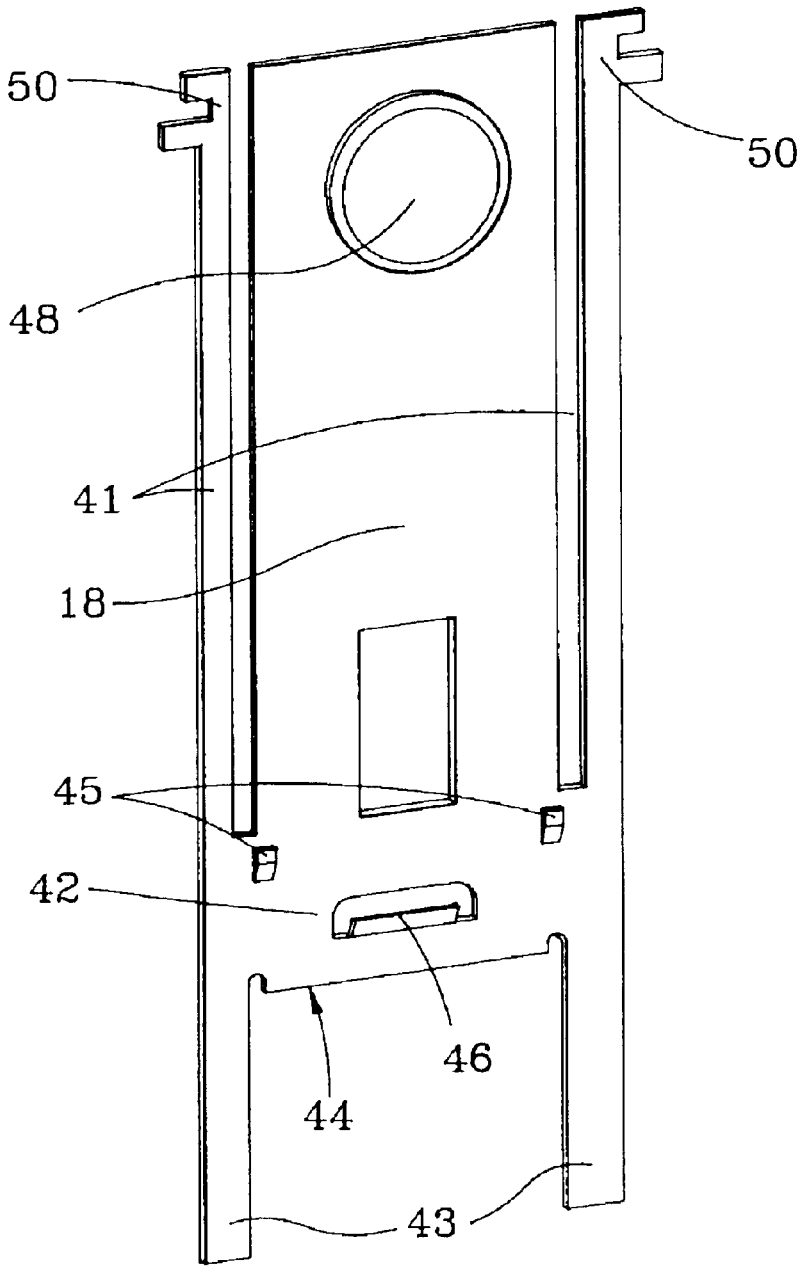
FIG. 7 is a perspective view of a switching spring with two armature springs of the relay of FIG. 1.
Figure 10:
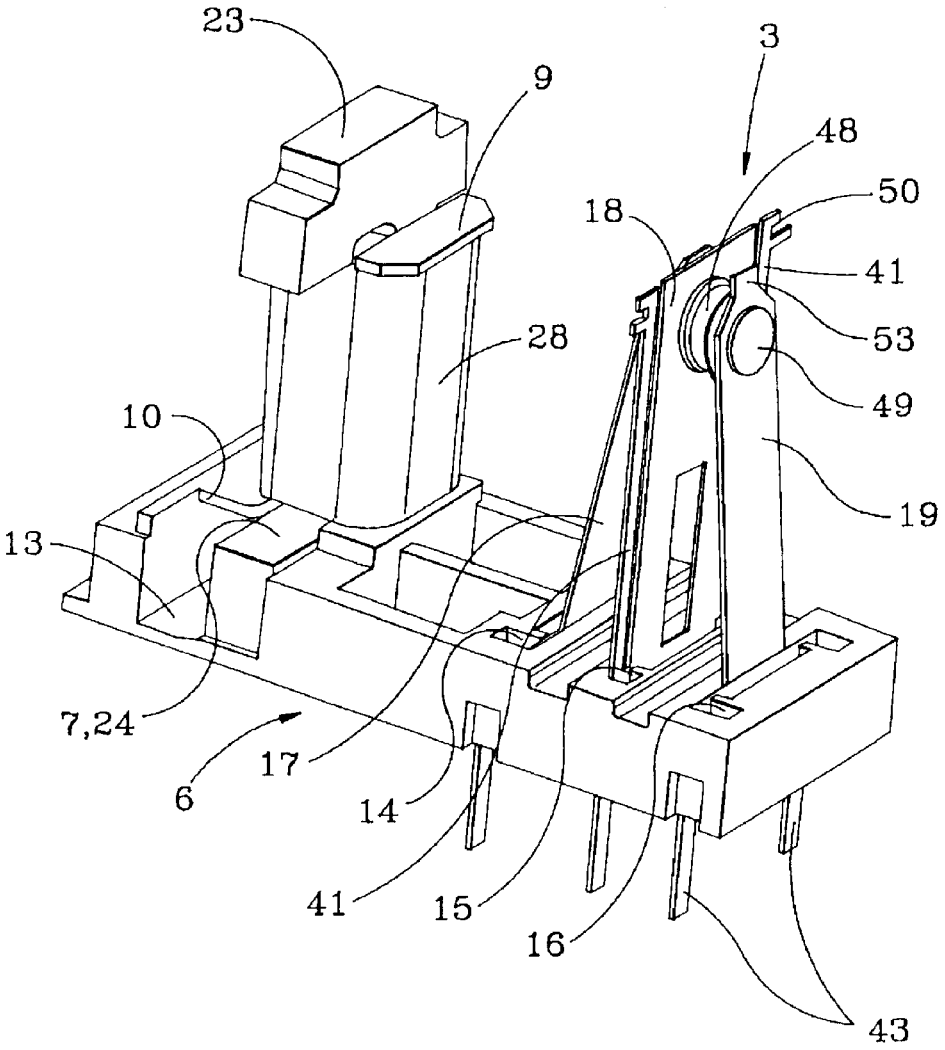
FIG. 10 is a perspective view of the coil base member of FIG. 2 with the yoke, the spring system and a coil.

Shown in FIG. 7, the switching spring 18 has armature springs 41 and a double-sided contact 48. The armature springs 41 are constructed as spring arms and are arranged parallel to and at a distance from longitudinal sides of the switching spring 18. The armature springs 41 and switching springs 18 together exhibit the width of the foot element 42 and are connected together in one piece thereby while remaining functionally independent. The armature springs 41 serve to reset the tilting armature 20 and at the same time act as a spring-side bearing for the comb 4. To this end, the armature springs 41 are provided at free ends with spring forks 50. Shown in FIGS. 1 and 10, the switching spring 18 is inserted into the insert slot 15 of the base member 6.

Figure 8:
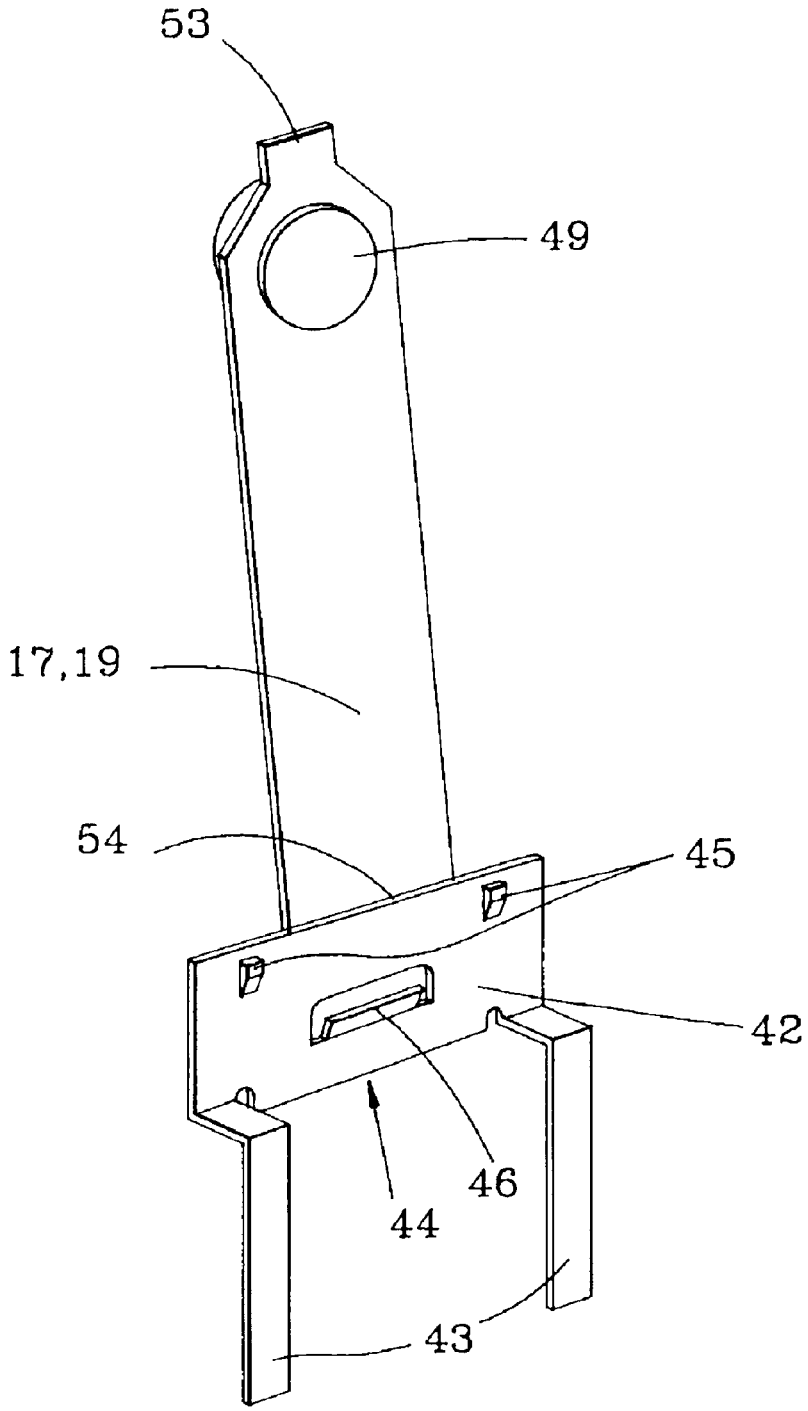
FIG. 8 is a perspective view of a release or operating spring of the relay of FIG. 1.

Shown in FIG. 8, the release and operating springs 17, 19 are of substantially identical construction and are narrower than the switching spring 18. The release and operating springs 17, 19 have a one sided contact 49 positioned at substantially the same level as the double-sided contact 48. At a free end of the release and operating springs 17, 19 is provided a stop lug 53. The release and operating springs 17, 19 are provided with a slight bend at a bend line 54 such that in the installation position the release and operating springs 17, 19 are inclined towards the switching spring 18 to simplify mounting of a cover 39. Shown in FIGS. 1 and 10, the release and operating springs 17, 19 are inserted in a mirror-inverted manner into the insert slots 14, 16 of the base member 6.

Figure 6:
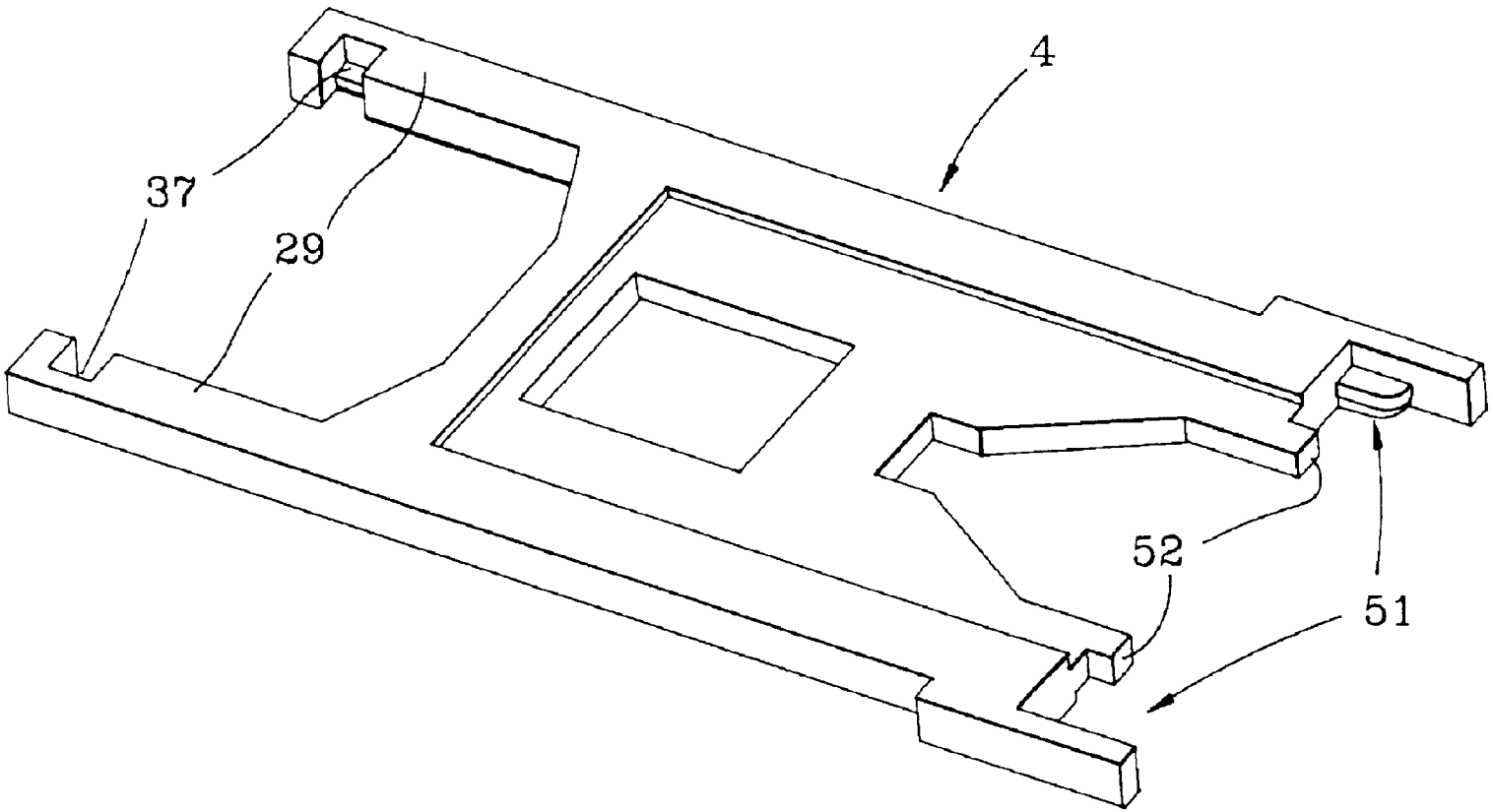
FIG. 6 is a perspective view of a comb of the relay of FIG. 1.

Shown in FIG. 1, the comb 4 extends between the magnet system 2 and the spring system 3. Shown in FIG. 6, at a first end of the comb 4 is a fork 29 provided with hinges 37. At a second end of the comb 4, the comb has spring-side hinges 51 and actuating lugs 52. As shown in FIG. 1, the spring-side hinges 51 of the comb 4 may be fitted into the spring forks 50 of the armature springs 41. The switching spring 18 is in pressure contact with the tilting armature 20 via the comb 4 and the actuating lugs 52, shown in FIG. 11.

Figure 11:
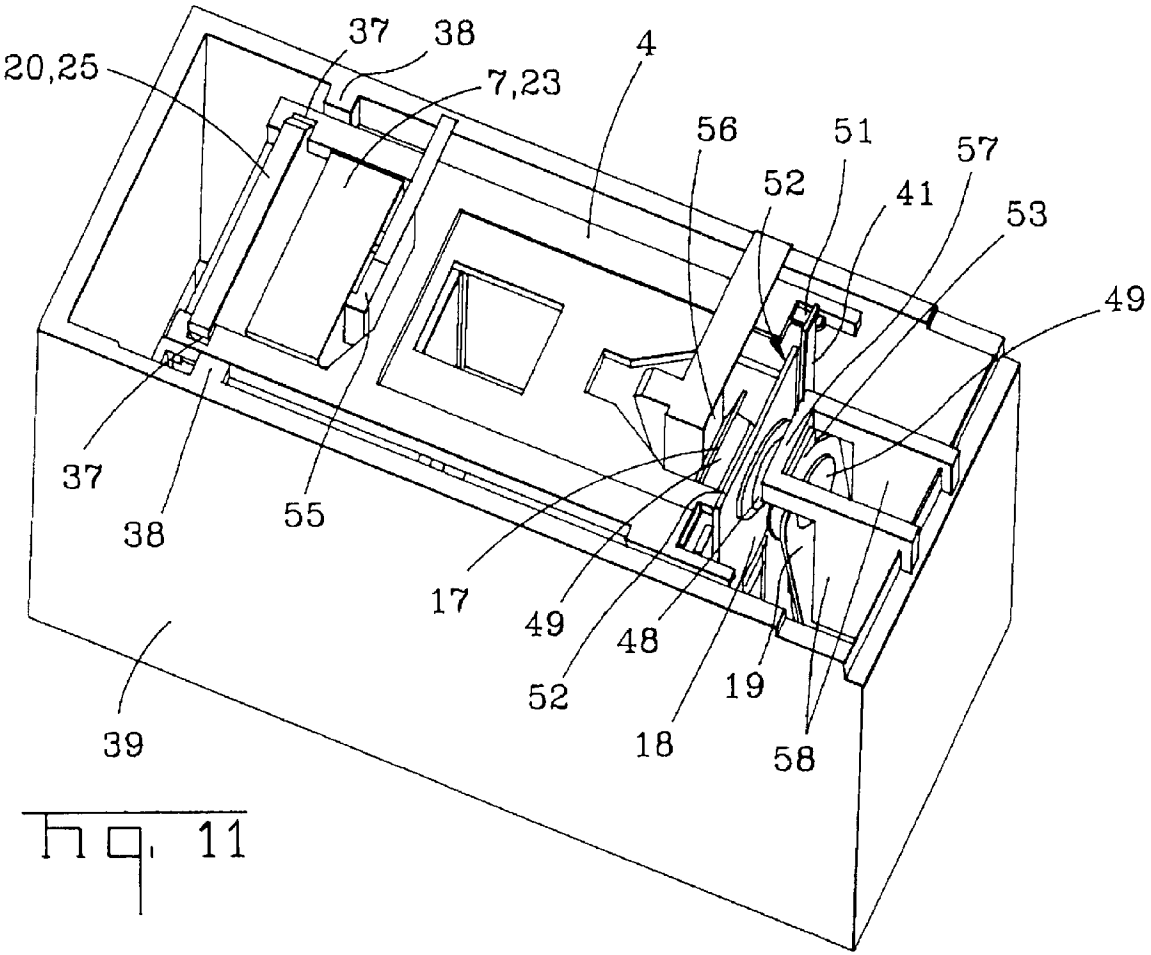
FIG. 11 is a perspective view of the relay of FIG. 1 with a cover shown without a top cover portion.
Figure 12:
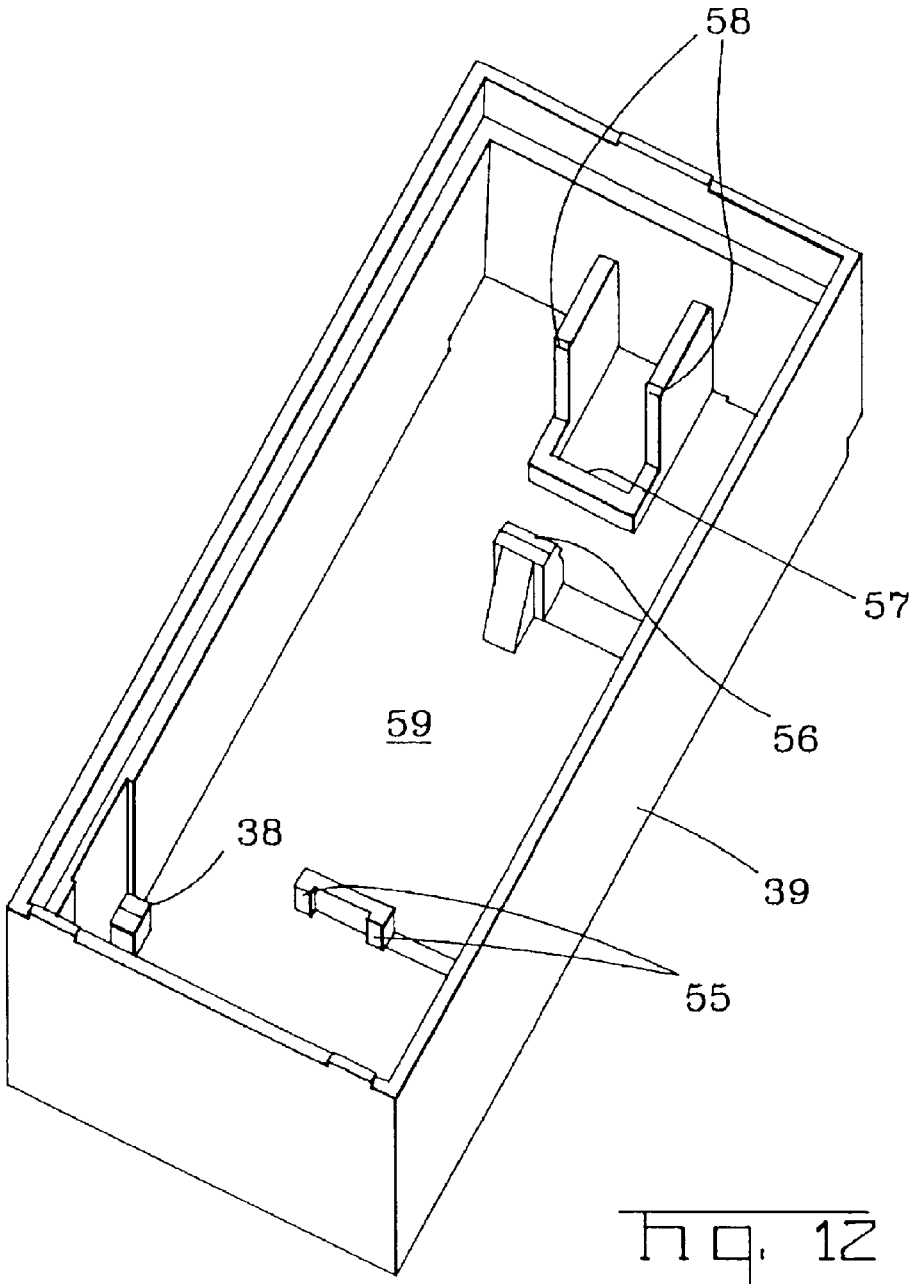
FIG. 12 is an internal perspective view of the cover of FIG. 11 with stops.

Shown in FIGS. 11 and 12, the cover 39 has a top cover portion 59 and stops 38, 55, 56, 57, 58 attached thereto. The first stop 38 lies on a side of the upper yoke cross-bar 23 close to the tilting armature 20. The second stop 55 adjoins the latter on the side remote from the tilting armature 20. In this way, the cover 39 is securely positioned relative to the magnet system 2 and the spring systems 3. The third stop 56 fixes the position of the release spring 17 such that when the one-sided contact 49 adjoins the double-sided contact 48 of the switching spring 18 when the tilting armature 20 is open, the circuit is closed. The fourth stop 57 positions the operating spring 19. The stop lug 53 of operating spring 19 adjoins the side of the fourth stop 57 positioned remote from the tilting armature 20 when the tilting armature 20 is open. The one-sided contact 49 of the operating spring 19 is positioned remote from the double-sided contact 48 of the switching spring 18 by the contact gap. The fifth stops 58 also position the operating spring 19 by shortening the bending length thereof and increase the operating spring 19 stiffness. The stops 38, 55, 56, 57 and spring system 3 are brought into the desired position by positioning the cover 39 on the relay, dispensing with complex individual adjustments of the release spring 17, operating spring 19 and switching spring 18.

The operation of the relay will now be described in greater detail. Shown in FIG. 1, when the tilting armature 20 is open, the one-sided contact 49 of the release spring 17 contacts the double-sided contact 48 of the switching spring 18. A closed-circuit current flows through the one-sided contact 48 and the double-sided contact 49. After energisation of the coil 28 via the contact pins 60, shown in FIG. 2, the tilting armature 20 picks up and transmits its movement via the hinge 37, the comb 4 and the actuating lugs 52, shown in FIG. 11, to the switching spring 18. The movement of the tilting armature 20 causes the double-sided contact 48 of the switching spring 18 to separate from the one-sided contact 49 of the release spring 17, which remains against the third stop 56, opening the circuit.

After the contact gap has been overcome, the double-sided contact 48 of the switching spring 18 and the one-sided contact 49 of the operating spring 19 merge to close the circuit. In order to achieve sufficient contact pressure, the switching spring 18 and the operating spring 19 experience overtravel that causes the operating spring 19 to lift from the fourth stop 57 and rest against the fifth stop 58. The bending length of the operating spring 19 is thereby reduced and the operating spring 19 contact force correspondingly is increased. In parallel with the switching spring 18, the armature springs 41 are pretensioned via the spring-side hinge 51. Once the coil 28 current has been switched off, the tilting armature 20 is displaced by the pretensioned armature springs 41 back into the open position. In this way, the open circuit is reopened and the closed circuit is closed.

A second embodiment of the relay is shown in FIGS. 13 to 20. The second embodiment of the relay functions in substantially the same manner and has substantially the same structure as the first embodiment of the relay shown in FIGS. 1 to 12. Similar components bear the same reference numerals, but with added accent. The components differing in detail from the first embodiment include yoke 7', tilting armature 20', comb 4', release springs 17', switching springs 18' and operating springs 19'.

FIG. 13 shows a relay having a coil base member 1' and a magnet system 2' connected to a spring system 3' by a comb 4'. Shown in FIGS. 13 and 14, the coil base member 1' is made out of an electrically insulating material and has an integrally connected coil member 5' and base member 6'. The coil member 5' is a substantially cylindrical hollow member with a substantially rectangular internal cross section corresponding to the cross section of a yoke 7', shown in FIG. 15. Shown in FIG. 14, the internal cross section comprises narrow inner sides 8' and has a collar 9' arranged at a free end. The collar 9' has a locating lug 40'.

Shown in FIG. 2, the base member 6' has side faces 12', a stepped-up bottom surface 13' and an upper side 11'. The base member 6 has first, second and third insert slots 14', 15', 16' and contact pins 60'. A side opening 10' extends from the narrow inner sides 8' of the coil member 5' to the upper side 11' and to the side faces 12' as far as the bottom surface 13'.

Shown in FIG. 13, the magnet system 2' comprises a coil 28', the yoke 7' and a tilting armature 20'. Shown in FIG. 15, the yoke 7' and the tilting armature 20' are of substantially identical configuration. It will be understood by those skilled in the art that since the yoke 7' and the tilting armature 20' are of identical construction, the yoke 7' and tilting armature 20' have similar features, irrespective of functional requirements.

The cross section of the yoke 7' and of the tilting armature 20' is substantially constant. The yoke 7' is substantially C-shaped and has a yoke web 21 integrally connected with upper and lower yoke bars 23', 24'. The tilting armature 20' is substantially C-shaped and has an armature web 22 integrally connected with upper and lower armature bars 25', 26'. At the upper edge of the upper yoke or armature cross-bars 23', 25', there is provided a step 61. An off-centre transverse yoke or armature groove 62 is provided in the upper yoke and armature cross-bars 23', 25'. The armature groove 62 allows an armature-side end of a comb 4' to pass through the upper yoke cross-bar 23' and at the same time allows the armature-side end of the comb 4' to be acted upon by the upper armature cross-bar 25'.

Figure 16:
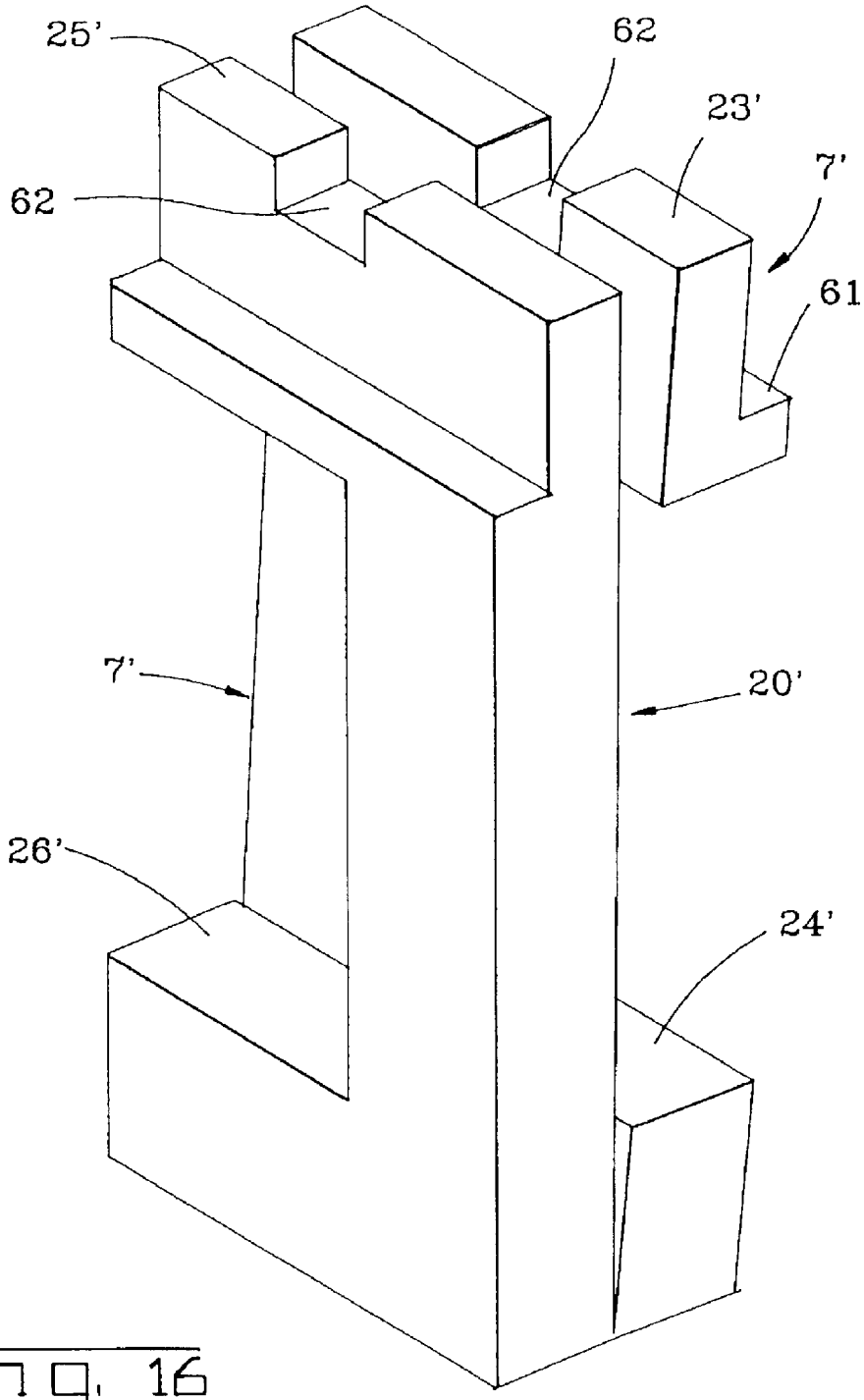
FIG. 16 is a perspective view of the yoke and the tilting armature of FIG. 15 in an installation position.
Figure 17:
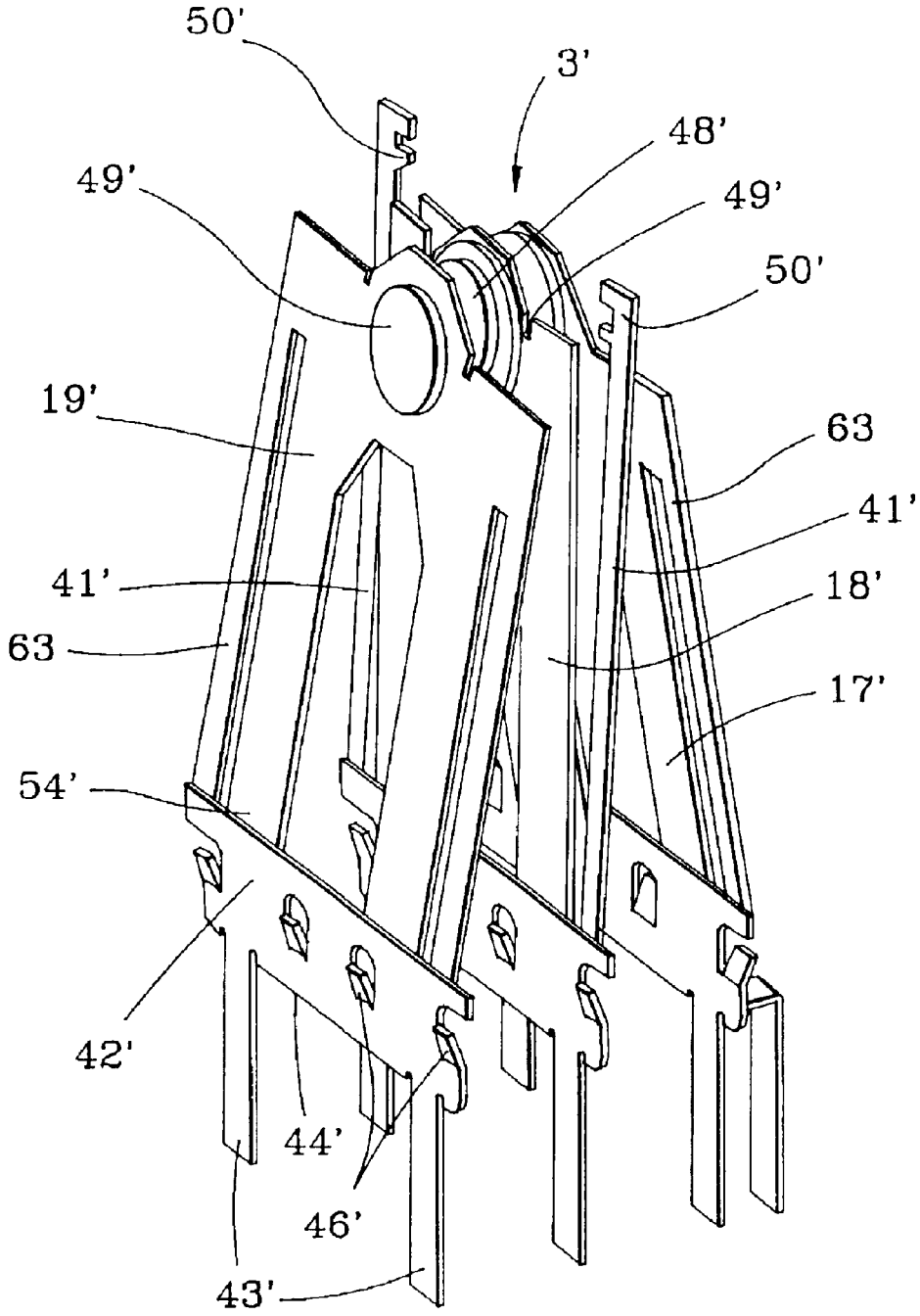
Figure 18:
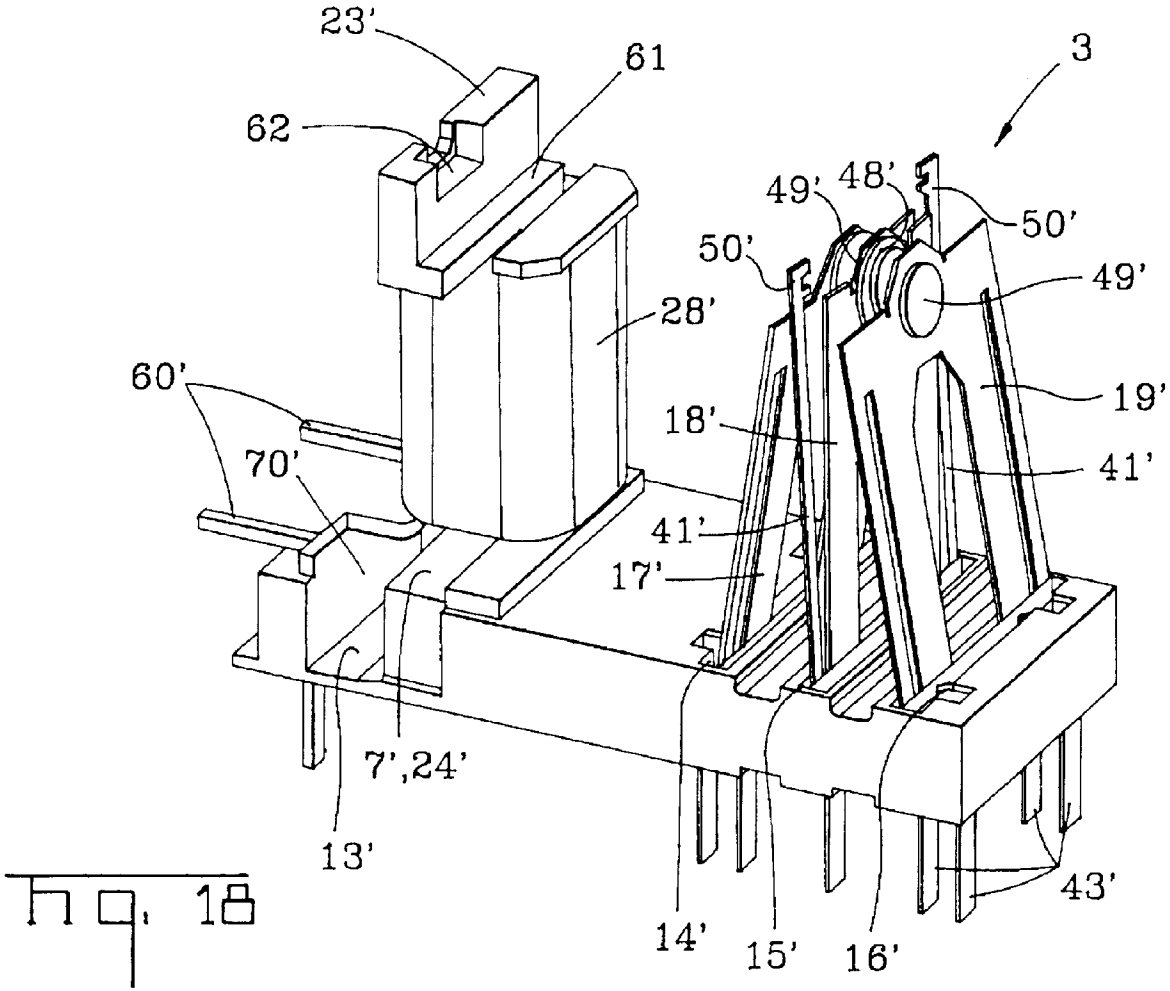
FIG. 18 is a perspective view of the coil base member of FIG. 14 with the yoke, the spring system and a coil.

Shown in FIGS. 13 and 16, the yoke 7' and the tilting armature 20' are mirror-inverted in a installation position for insertion into the side opening 10' of the coil base member 1' from the side. Shown in FIGS. 13 and 14, sufficient space is provided in the side opening 10' and at the stepped-up bottom surface 13' to accommodate movement of the tilting armature 20'. In contrast, the yoke 7' fits into the rectangular internal cross section of the coil member 5' with little additional space.

The resilient locating lug 40' provided on the collar 9' positions the yoke 7' laterally and snaps into the yoke 7' when the yoke 7' reaches the installation position. The coil 28' is wound around the yoke 7', guided by the collar 9', to fix the yoke 7' in the installation. The tilting armature 20' is guided by the edge of the side opening 10' and the lower armature cross-bar 26' as it is inserted in the base member 6'.

Figure 17:
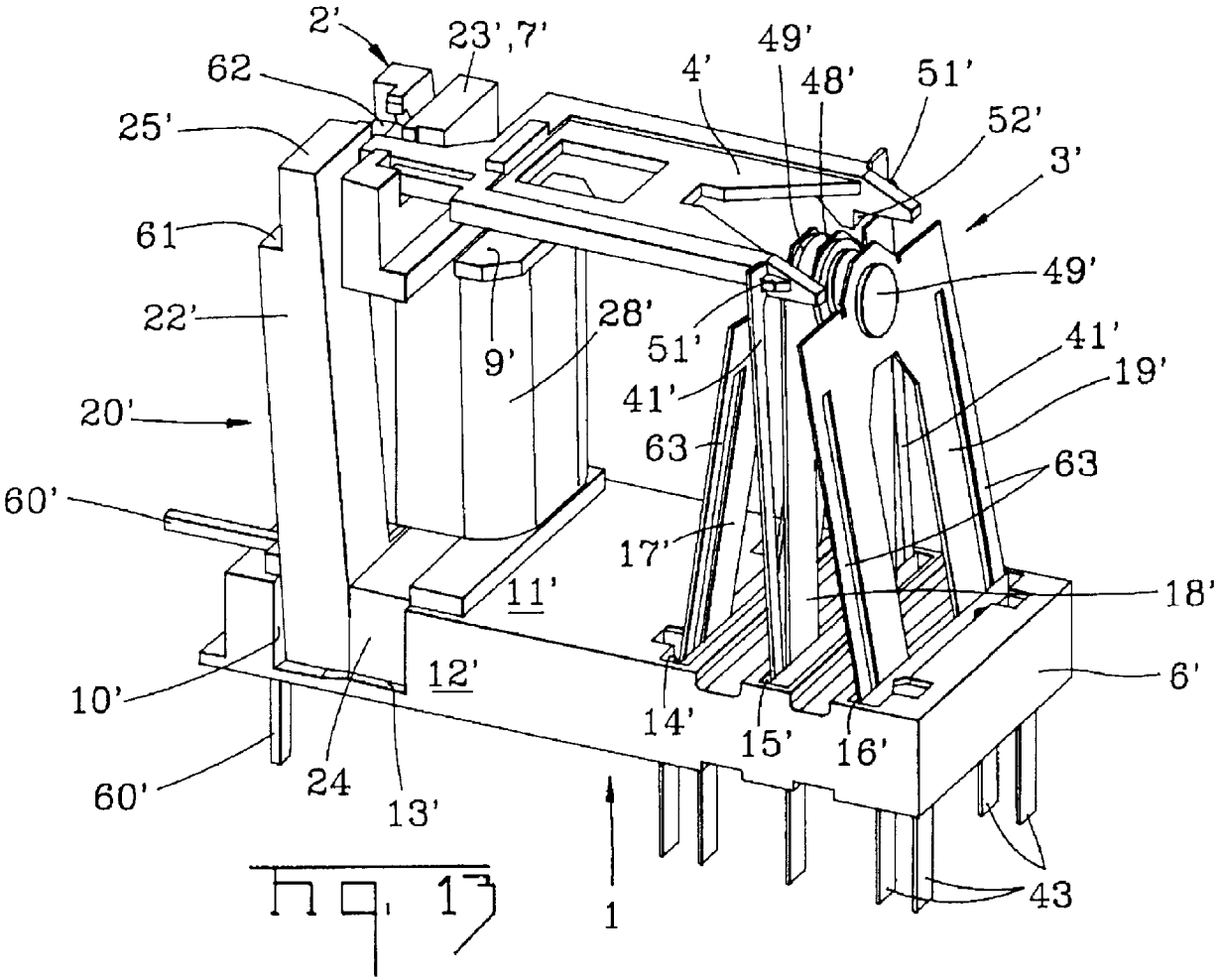
FIG. 17 is a perspective view of a spring system with switching spring, tilting armature and operating springs of the relay of FIG. 13.
Figure 14:
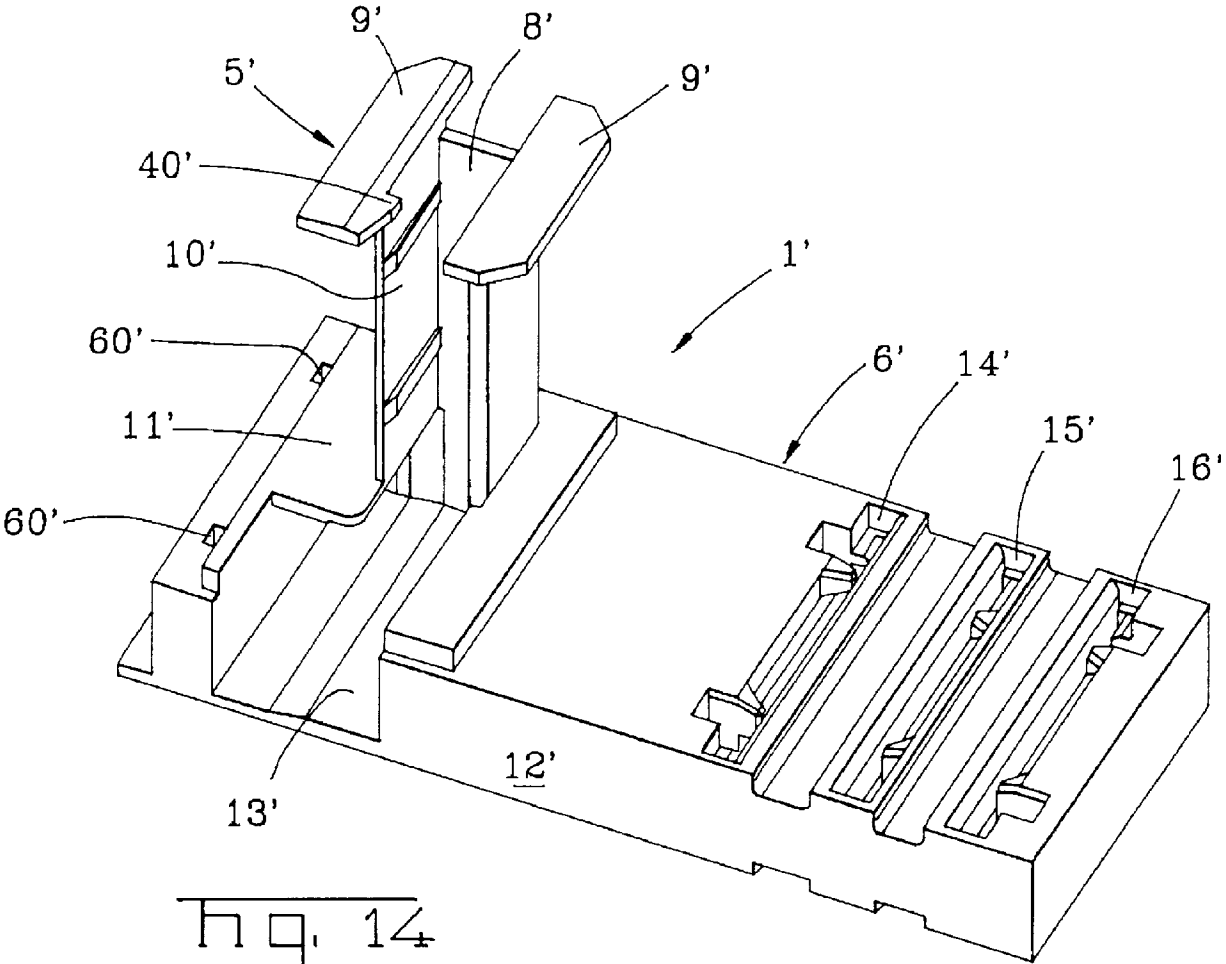
FIG. 14 is a perspective view of a coil base member of the relay of FIG. 13.
Figure 15:
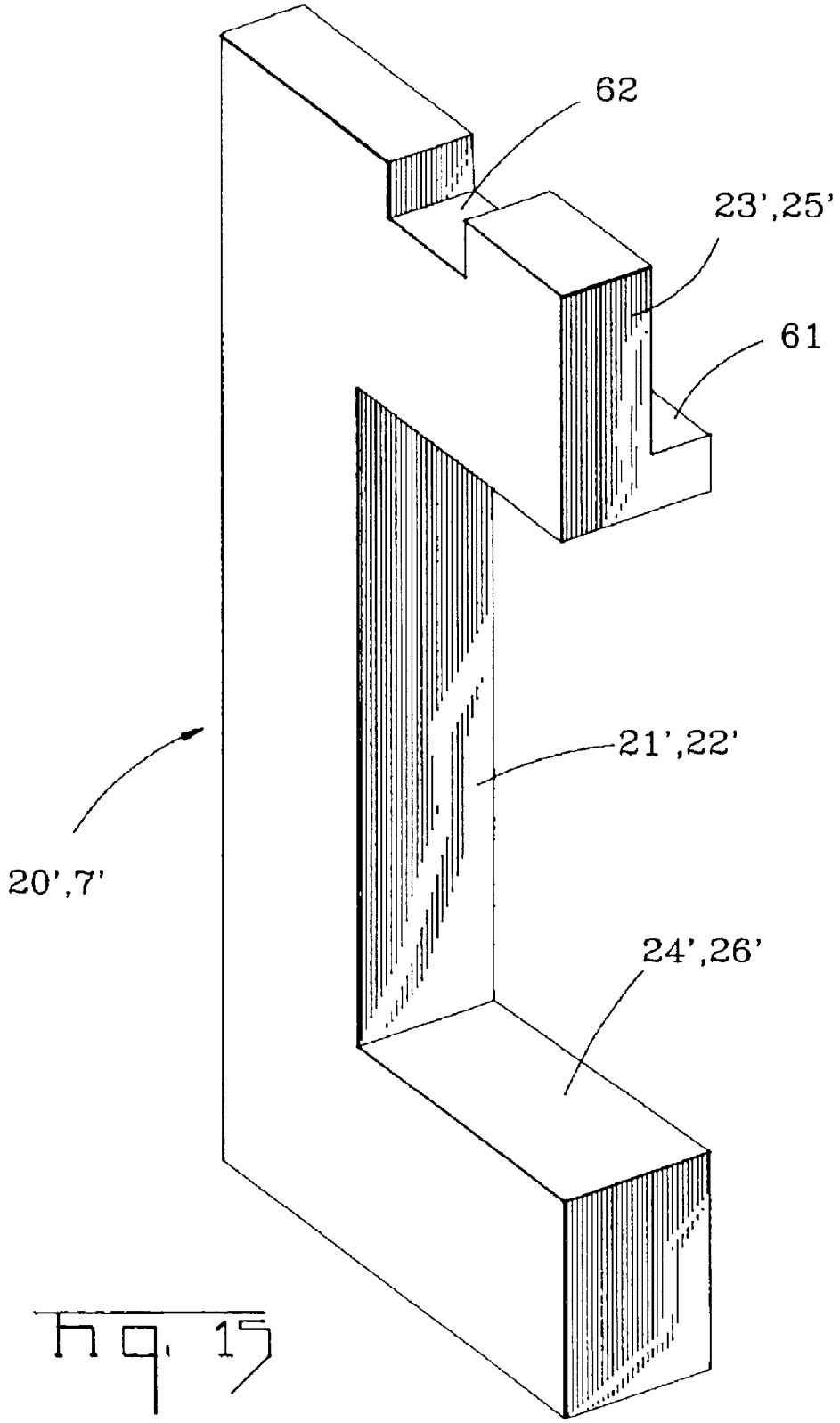
FIG. 15 is a perspective view of a tilting armature or yoke of the relay of FIG. 13.

Shown in FIG. 17, the spring system 3' has a release spring 17', a switching spring 18' and an operating spring 19'. The switching spring 18', the release spring 17' and the operating springs 19' are integrally connected by a substantially identically constructed foot element 42' and are preferably formed from the same die. Each of the foot elements 42' has a contact tongue 43' integrally connected with the foot element 42 and locking devices 46'. Depending on the desired spacing of the contact tongues 43', the contact tongues 43' are formed to be either straight or bent. Positioned between the contact tongues 43' is a depth end stop 44'. The release and operating springs 17', 19' are inserted with the foot elements 42' in a laterally reversed manner into the insert slots 14' and 16'. The depth end stop 44' contacts a bottom surface of one of the insert slots 14', 15', 16' and the locking devices 46' automatically engage with the insert slots 14', 15', 16' when a given depth is reached to fix the foot elements 42' in place.

Shown in FIG. 17, the release and operating springs 17', 19' are of substantially identical construction and are narrower than the switching spring 18'. The release and operating springs 17', 19' have a one-sided contact 49' positioned at substantially the same level as the double-sided contact 48'. The release and operating springs 17', 19' are provided with a slight bend at a bend line 54' such that in the installation position the release and operating springs 17', 19' are inclined towards the switching spring 18' to simplify mounting of the cover 39'. Spring arms 63 are arranged parallel to each of the longitudinal sides of the release and operating springs 17', 19'. The spring arms 63 are integrally connected with the foot elements 42.'

Shown in FIG. 17, the switching spring 18' has armature springs 41' and a double-sided contact 48'. The armature springs 41' are constructed as integrally connected spring arms 63 and are formed by cutting free the spring arms 63 at the free end of the switching spring 18'. The armature springs 41' are arranged parallel to and at a distance from longitudinal sides of the switching spring 18'. The armature springs 41' and switching springs 18' together exhibit the width of the foot element 42' and are connected together in one piece thereby while remaining functionally independent. The armature springs 41' serve to reset the tilting armature 20' and at the same time act as a spring-side bearing for the comb 4'. To this end, the armature springs 41' are provided at free ends with spring forks 50'. Shown in FIGS. 13 and 18, the switching spring 18' is inserted into the insert slot 15' of the base member 6'.

Figure 19:
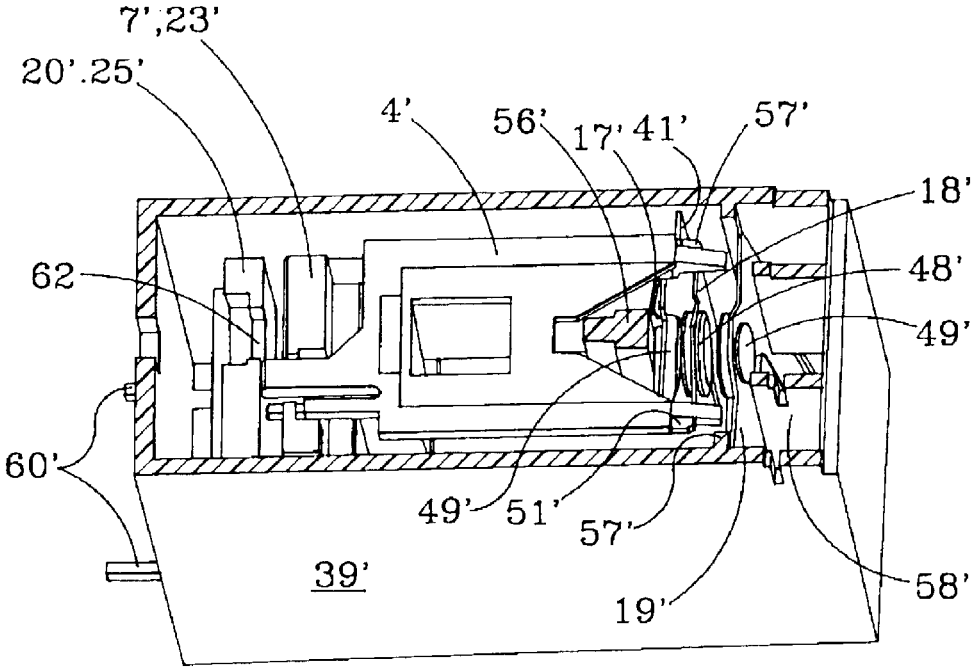
FIG. 19 is a perspective view of the relay of FIG. 13 with a cover shown without a top cover portion.

Shown in FIGS. 13 and 19, the comb 4' extends between the magnet system 2 and the spring system 3. At a first end of the comb 4' is a first and second projection that engage the transverse groove 62 in the yoke 7' causing the comb 4' to be in pressure contact with the upper armature cross-bar 25' and the switching spring 18' as well as with the armature springs 41'. At a second end of the comb 4', the comb has spring-side hinges 51' and actuating lugs 52'. The spring-side hinges 51' of the comb 4' may be fitted into the spring forks 50' of the armature springs 41'. The switching spring 18' is in pressure contact with the tilting armature 20' via the comb 4' and two actuating lugs 52'.

Figure 20:
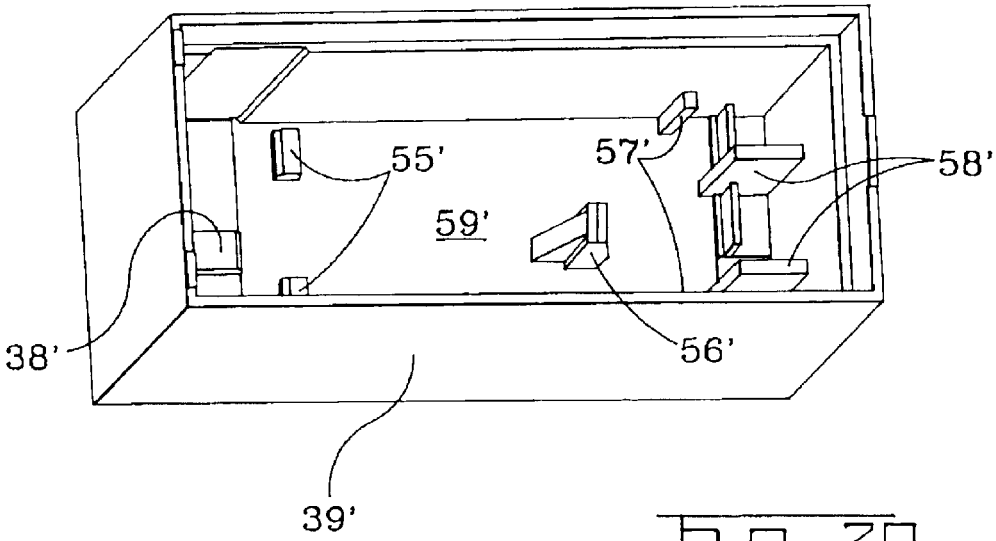
FIG. 20 is an internal perspective view of the cover of FIG. 19 with stops.

Shown in FIGS. 19 and 20, the cover 39' has a top cover portion 59' and stops 38', 55', 56', 57', 58' attached thereto. The first stop 38' lies on the side of the upper yoke cross-bar 23' close to the tilting armature 20' in the area of the transverse groove 62 in the tilting armature 20'. The second stops 55' adjoin the ends thereof on a side remote from the tilting armature 20'. In this way, the cover 39' is securely positioned relative to the magnet and spring systems 2' and 3'. The third stop 56' fixes the position of the release spring 17' such that when the one-sided contact 49' adjoins the double-sided contact 48' of the switching spring 18' when the tilting armature 20' is open, the circuit is closed. The fourth stops 57' positions the operating spring 19' that adjoins the side of the fourth stops 57' remote from the armature when the tilting armature 20' is open. The one-sided contact 49' of the operating spring 19' is positioned remote from the double-sided contact 48' of the switching spring 18' by the contact gap. The fifth stops 58' of the operating spring 19' shortens the bending length of the operating spring 19' and increases the operating spring 19' stiffness. The stops 38', 55', 56', 57', 58' and the spring system 3' are brought into the desired position by positioning the cover 39' on the relay, dispensing with complex individual adjustments of the release spring 17', operating spring 19' and switching spring 18'.

The second embodiment of the relay functions in substantially the same manner as the relay of the first embodiment, such that the description of the functioning of the second embodiment will be understood to be substantially the same as the first embodiment by those skilled in the art.

In comparison to separately produced base and coil members, the present one-piece construction of the first and second embodiments of the relay are distinguished by low manufacturing and assembly costs and relatively high strength. Some of the advantages of the first and second embodiments of the relay are described hereafter.

The side opening of the coil base member simplifies production thereof and allows lateral mounting of the yoke and the tilting armature. Moreover, the omission of the side wall of the coil member provides more space for the cross section of the coil and/or for the cross section of the yoke and tilting armature. This increases the force of the magnet system.

The side opening of the coil base member also allows use of a one-piece yoke, which is inserted into the coil base member from the side prior to winding of the coil and enclosed and fixed in position by winding.

The side opening is so designed that the opening cross section required for lateral insertion of yoke and tilting armature and for the tilting movement thereof is provided.

The resilient locating lug on the collar at the edge of the side opening effects automatic lateral fixing of the yoke during insertion thereof into the coil base member.

An advantageous configuration of the invention consists in the fact that the insert slots are arranged spacedly one behind the other in the base member. In this way, a neat spring system is obtained, which is suitable for a uniform spring configuration.

The C-shape of the yoke, consisting of a yoke web and upper and lower yoke cross-bars makes it possible for the yoke web thereof to function as a coil core and for the yoke cross-bars thereof to project laterally beyond the coil at both ends. The C-shape of the tilting armature and the mirror-inverted arrangement thereof allows the armature web to effect the tilting movement in front of and the upper and lower armature cross-bars thereof to effect the same respectively above and beneath the coil. Due to the mirror-inverted arrangement of yoke and tilting armature, large-area contact of the cross-bars occurs, with optimum magnetic flux.

An advantageous further development of the invention consists in the fact that the cross section of the armature web decreases continuously on its side remote from the yoke towards the upper armature cross-bar and the cross section of the upper armature cross-bar decreases in stepped manner towards its upper end. Due to the cross-sectional reduction towards the upper end of the tilting armature, the rotary moment of inertia thereof reduces, whereby the closing speed and vibrational insensitivity thereof are increased.

Because a last step of the upper armature cross-bar comprises a transverse groove at its two ends, into which corresponding hinges of the comb may be snapped or fitted, simple comb mounting and precise comb guidance are achieved.

For quick winding of the coil, it is advantageous for the lower cross-bar of the yoke to comprise an extension projecting beyond the yoke web thereof, which engages in a corresponding extension receiving recess in the coil base member. In this way, the magnet system is able to meet the demands made of it by manufacture.

It is also advantageous for the yoke and a the tilting armature to be of identical construction. The identical nature of the yoke and tilting armature is of considerable significance with regard to reducing relay manufacturing costs. Only one die and one inventory item are necessary for both.

An advantageous further development of the invention consists in the fact that the upper yoke or armature cross-bar comprises an off-centre transverse groove and, at its upper edge facing away from the contact side, a step. The step in the upper cross-bar reduces the rotary moment of inertia thereof, whereby the closing speed and vibrational sensitivity of the tilting armature are increased.

The transverse groove serves to guide the comb at its end remote from the spring. The off-centre arrangement of the transverse grooves has the effect that they are not aligned in the installation position, but instead are staggered, so simultaneously allowing the tilting armature to act on the comb and the yoke to guide the comb.

Locking devices are provided on the foot elements of the springs that lock automatically together with the insert slots when the foot elements are inserted therein and fix the position of the springs. In this way, mounting of the springs is simplified. They have merely to be inserted into the insert slots in the base member as far as the depth end stop. Locking and thus positional fixing of the springs then occur automatically.

The release and operating springs are inclined towards the switching spring located therebetween in the installation position. In this way, among other things mounting of the cover is simplified.

A simple spring system structure is achieved in that the switching spring preferably comprises an armature spring parallel with each outer side. The armature springs are connected with the switching spring via the foot element. In this way, three independent springs are arranged on the foot element of the switching spring.

It is particularly advantageous that the armature springs serve to reset the tilting armature and at the same time act as a spring-side bearing for the comb. Moreover, mounting of the comb on the spring arms has the advantage over conventional mounting in the switching spring of a larger distance between the bearings and the switching contacts. In this way, the risk of contact disturbance by plastics abrasion is reduced. The two armature springs also offer advantages in the case of a bipolar variant of the relay.

It is also advantageous that contact tongues are arranged in each of the edge areas of the ends remote from the springs of the foot elements and have depth end stops located therebetween. In this way, exact positioning of the foot elements and, thus, of the springs is ensured. The operating spring and the armature springs are also made with one die. This provides significant manufacturing advantages. The individual springs differ inter alia in the number and construction of contact tongues and contacts as well as in the cutting-free of two armature springs, which is effected subsequently.

The cover comprises first and second stops on the inside of its top for lengthwise fixing thereof to the yoke and third, fourth and fifth stops for defining and fixing the lengthwise position of the release, switching and operating springs and for increasing the spring stiffness of the latter. By fixing the cover to the yoke, no cover-related tolerances arise between magnet and spring system. In contrast to springs with separately adjusted break contact pressure, contact spacing and overtravel, the manufacturing and assembly costs are reduced decisively in the case of the solution according to the invention. This merely requires setting in place of the cover, whereby all the stops reach the desired position. By the precise, accurate adjustment, effected automatically during mounting of the cover, of the switching contact values determining service life, the service life of the relay is markedly increased.

While the present invention has been described in relation to the illustrated embodiments, it will be appreciated and understood that modifications may be made without departing from the true sprint and scope of the invention. For example, both relays may also be constructed with two or more contacts and a plurality of spring systems to obtain substantially similar results.

We claim:

1. A relay comprising:

a coil base member having a base member with an upper side, side faces and a bottom surface and a coil member with inner sides, the base member and coil member being integrally connected; and the coil base member having a continuous opening in the side of the coil member and one of the side surfaces of the base member, the opening partially defined by the inner sides of the coil member mid extending the length of the coil member to the bottom surface of the base member wherein the opening is configured to receive a yoke and tilting armature therein.

2. The relay of claim 1 wherein the coil base member has an extension receiving recess in the base member aligned with the opening to receive an extension formed on the yoke.

3. The relay of claim 1, wherein the coil member has a collar having a locating lug adjacent to the opening for positioning a yoke.

4. The relay of claim 1, wherein the base member has three or more insert slots positioned parallel to each other.

* * * * *